United States Patent [19]

Wooden, Jr.

[11] Patent Number: 4,745,769

[45] Date of Patent: May 24, 1988

[54] CENTRAL AIR CONDITIONER COVER APPARATUS

[76] Inventor: Odell Wooden, Jr., 1439 Pruitt St., Indianapolis, Ind. 46208

[21] Appl. No.: 91,061

[22] Filed: Aug. 31, 1987

[51] Int. Cl.[4] ..... F25D 23/12

[52] U.S. Cl. ..... 62/259.1; 62/262; 62/DIG. 16; 150/52 R; 312/100

[58] Field of Search ..... 150/55, 52 R; 62/259.1, 62/262, 304, DIG. 16; 312/100; 98/31

[56] References Cited

U.S. PATENT DOCUMENTS

| | | | |
|---|---|---|---|
| 2,711,769 | 6/1955 | Katcher et al. | 150/52 |
| 3,320,996 | 5/1967 | Singer | 150/52 |
| 3,379,481 | 4/1968 | Fisher | 312/100 |
| 4,308,905 | 1/1982 | Gallagher | 150/52 |
| 4,498,912 | 2/1985 | Wagner | 62/DIG. 16 |
| 4,625,784 | 12/1986 | Boroson | 150/52 |

*Primary Examiner*—Lloyd L. King

*Attorney, Agent, or Firm*—Henderson & Sturm

[57] ABSTRACT

A universal cover for covering air conditioner compressor cabinets or the like which can be installed easily to protect the cabinet housing and the working parts therein. A sheet of flexible material, such as canvas, is provided with numerous strategically-placed fasteners and openings to allow the cover to fit a wide range of cabinet sizes.

1 Claim, 2 Drawing Sheets

CENTRAL AIR CONDITIONER COVER APPARATUS

TECHNICAL FIELD

This invention relates to adjustable covers and more specifically is directed to an adjustable weather-proof cover particularly adapted for use in protecting a central air conditioner compressor cabinet or the like against the elements and other foreign matter.

BACKGROUND ART

Central air conditioning has become prevalent in many private residences. In multi-seasonal climates where it is only used for one season of the year, the externally disposed compressor cabinet and associated equipment housed within are not used during the other seasons. When inoperative, there is a tendency for dust, dirt and the like to collect within the compressor cabinet, thereby having a deleterious effect on the static and dynamic parts. Moreover, the sheet metal cabinet housing the working parts serves to amplify the sound of rain, sleet, snow or hail with the expected disturbing effect on the occupants of the premises. In the past, custom made covers have been used to protect compressor cabinets against the elements during periods of non-use, however these covers are extremely expensive when compared to those which are mass produced to a uniform size.

A wide variety of air conditioners are available and considerable variance exists in the size of the compressor cabinets for different sizes and competitive models. Accordingly, any cover which may be provided for protecting the compressor cabinets over the periods of non-use must be adjustable in order to accommodate most models and types if the benefits of mass production are to be obtained.

Consequently, there is a need for a universal air conditioner which is economical to produce, easy to install and is dependable.

DISCLOSURE OF THE INVENTION

The present invention relates to a cover which may be used for air conditioner compressor cabinets or the like, and which is readily installed to protect the cabinet and working parts housed therein. The adjustable cover of the present invention through an ingenious arrangement of elastic bands and strategically placed fasteners is adjustable to fit a wide range of cabinet sizes and is easily installed by an unskilled person. As will be seen, the adjustable cover of the present invention is formed of one sheet of material to cover a compressor cabinet and present an attractive appearance while precluding cabinet deterioration and entry of foreign matter into the interior of the cabinet.

It is an object of this invention to provide a one-piece adjustable cover adapted for use in covering air conditioner cabinets and the like.

It is a further object of this invention to provide a new and improved air conditioner cabinet cover which is adjustable over wide ranges of sizes.

It is a still further object of this invention to provide an adjustable air conditioner cover which will fit a wide range of units, which is easily installed, will remain firmly in place once installed, and present a neat appearance.

Other objects, advantages, and novel features of the present invention will become apparent from the following detailed description of the invention when considered in conjunction with the accompanying drawings.

BEST MODE FOR CARRYING OUT THE INVENTION

Figure 1:
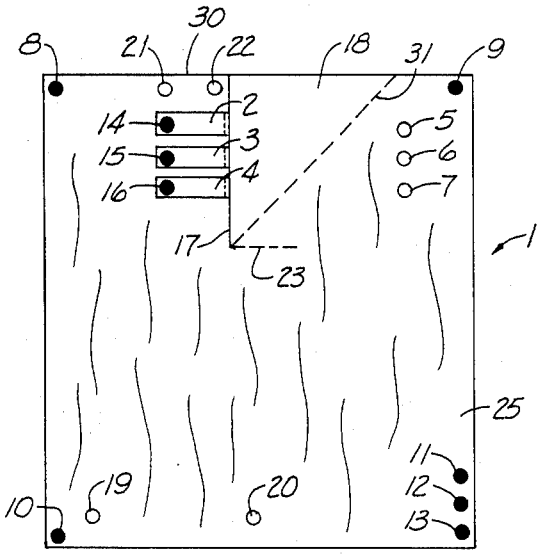
FIG. 1 is a top-elevational view of a preferred embodiment of the present invention showing a sheet of canvas or other flexible material which has been modified and has several structural elements added thereto.

Referring now to the drawings wherein like reference numerals designate identical or corresponding parts throughout the several views, FIG. 1 shows a central air conditioner cover apparatus constructed in accordance with the present invention and being formed of a flexible canvas sheet (25). It is to be understood, of course, that other types of flexible material can be used, such as another fabric or a sheet of plastic.

Figure 2:
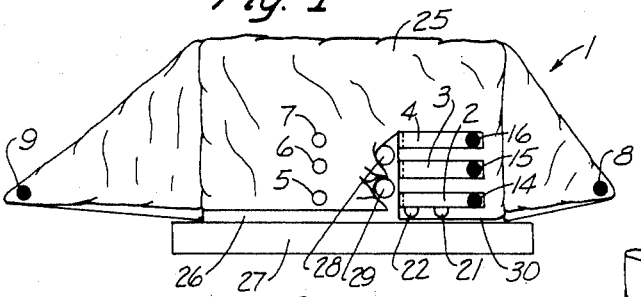
FIG. 2 is an additional step showing how the preferred embodiment of FIG. 1 can be draped over a central air conditioning housing and the corners folded.
Figure 6:
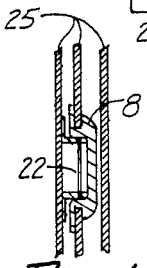
FIG. 6 is an enlarged partial cross-sectional view taken along line 6—6 of FIG. 3.

A central air conditioning housing (26) is shown in FIG. 2 mounted on a concrete slab (27). To install the cover (1) to the central air conditioner housing (26), it would first be draped over the top of such air conditioner cabinet (26) in a position so that the fluid conduit pipes (28 and 29) extend past a slit (17), which extends from a first edge (30) of the sheet (25) to a place inwardly therefrom. The flap (18) is then folded into a triangle along the dash line (31) so as to provide an opening for fluid conduit pipes (28 and 29). Alternatively, the triangular flap (18) can be cut out entirely from the sheet (25), thereby leaving a void where the flap (18) is indicated. Another slit along the dash line (23) can also be cut, if it is required because of the configuration of pipes or conduits such as fluid conduits (28 and 29). A first fastener (8) is attached to a first corner of the sheet and a second fastener (9) is attached to the second corner of the sheet. For the purpose of this illustration, the first and second fasteners include the button and female portion of a snap. Fasteners (10, 11, 12, 13, 14, 15, and 16) are also of the type like fastener (8) which has a female portion for receiving and holding a male snap portion. Male snap fasteners (5, 6, 7, 19, 20, 21, and 22) are of the type shown in FIG. 6 as projection 22.

Elastic members (2), (3) and (4) are sewn to the sheet (25) along the slit (17) as can readily be seen in FIG. 1.

Figure 7:
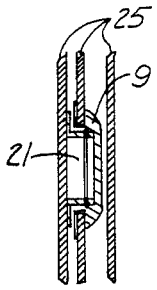
FIG. 7 is an enlarged partial cross-sectional view taken along line 7—7 of FIG. 4.
Figure 8:
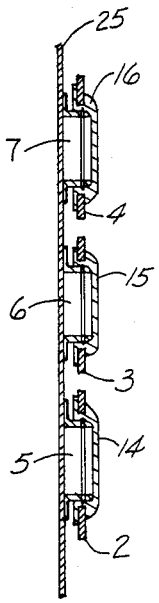
FIG. 8 is an enlarged partial cross-sectional view taken along line 8—8 of FIG. 3.
Figure 4:
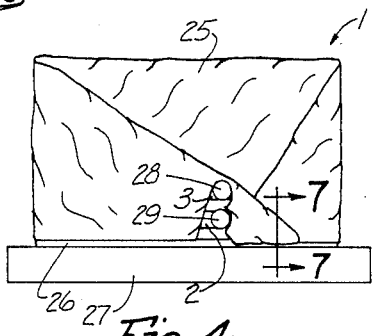
FIG. 4 is a view like FIGS. 2 and 3 but showing the final step of folding that particular side to enclose the air conditioner housing.
Figure 3:
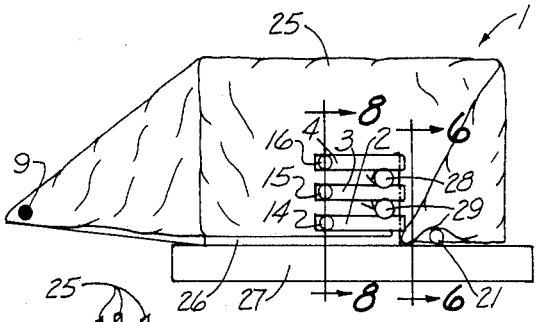
FIG. 3 is a side elevational view like FIG. 2 but showing one side fastened in place and elastic straps extending between and around air conditioner pipes.
Figure 5:
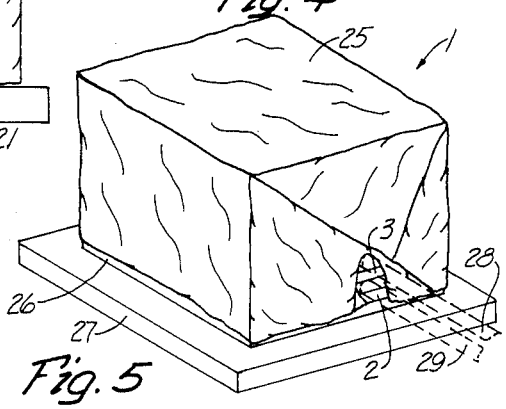
FIG. 5 is a perspective view showing the air conditioner cover apparatus of the present invention shown installed on an air conditioner housing and showing the side where the pipes extend from the housing.

After the cover (1) is draped over the air conditioner housing (26) then the corners pleated as shown in FIG. 2. The snap fastener (8) is snapped over the male fastener (22) so that the apparatus is in position shown in FIG. 3. At the same time, the first, second and third elastic members (4, 3 and 2) are stretched across the slit (17) to engage fasteners (7, 6 and 5) respectively. This holds the cover securely around the pipes (28) and (29). Then the other flap shown in FIG. 3, having fastener (9) thereon, is folded over to the position shown in FIG. 4 and the fastener (9) is fastened together with the male fastener (21). This can readily be seen in FIG. 7. Consequently, one end of the cover (1) will be secured in place, as is readily shown in the perspective view of FIG. 5 with the fluid conduits (28) and (29) extending therethrough.

Figure 9:
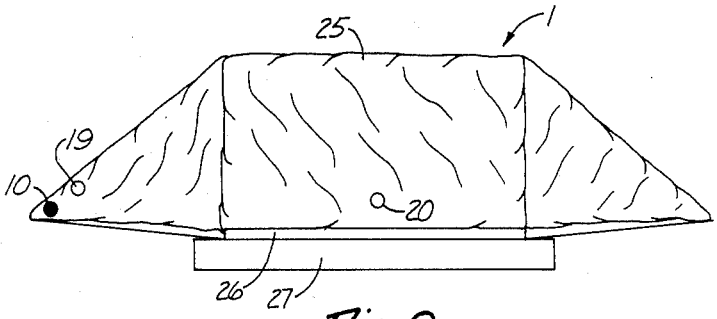
FIG. 9 is a side-elevational view of the opposite side of the air conditioner housing and cover from that shown in FIGS. 2-4 in an initial stage of being installed.
Figure 13:
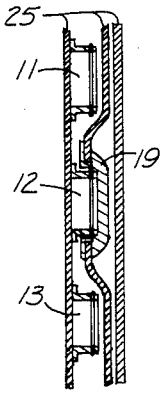
FIG. 13 is a cross-sectional view taken along line 13—13 of FIG. 11.
Figure 11:
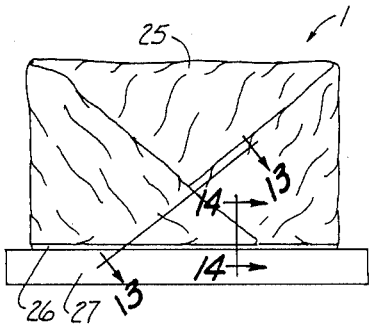
FIG. 11 is a view like FIGS. 9 and 10 but showing the left-most flap folded and fastened into place to complete the installation of the central air conditioner cover apparatus.
Figure 10:
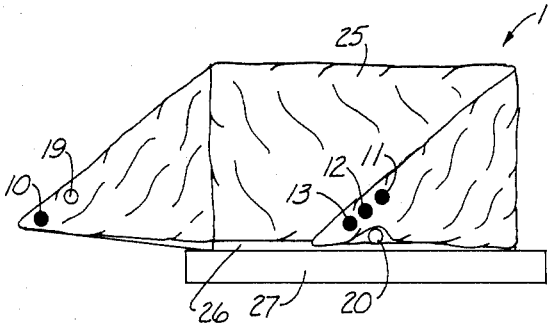
FIG. 10 is a view like FIG. 9 but showing one side being fastened in place.
Figure 14:
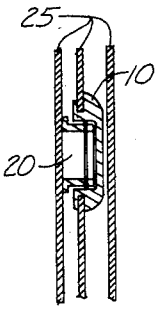
FIG. 14 is an enlarged partial cross-sectional view taken along line 14—14 of FIG. 11.
Figure 12:
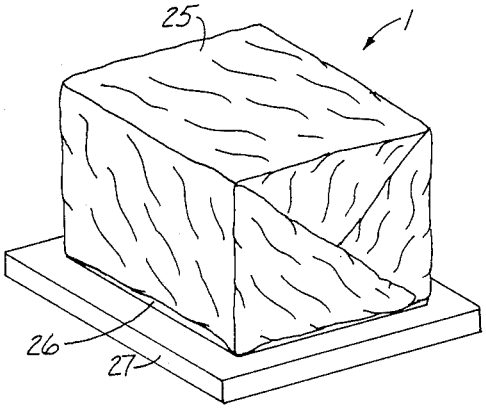
FIG. 12 is a perspective view of the present invention shown installed on a central air conditioner housing on the opposite side from the perspective view of FIG. 5.

The other end of the cover (1) would then be placed in the position shown in FIG. 9 wherein two of the corners are folded apart. Then the right side, as shown in FIG. 9, is folded over to the position shown in FIG. 10, exposing fasteners (11, 12 and 13) and also allowing access to the male snap (20). The left flap, as shown in FIG. 10, is then folded over so as to connect fastener (10) with the male fastener (20), as shown in FIG. 14, and also engaging the fastener (19) with one of the three fasteners (11, 12 or 13), depending upon the degree of tightness desired due to the size of the air conditioner housing (26). The completed end of the cover (1) is shown in FIGS. 11 and 12.

It is also to be understood that other types of fasteners can be used instead of snaps. For example, referring to FIG. 1, it is noted that the dark-colored female fasteners like fastener (8) could be of one complementary part of a Velcro fastener and the light-colored fasteners such as (22) could be of another complementary Velcro component so that the numbered fasteners can be attached together with Velcro instead of with snaps.

Accordingly, it will be appreciated that the preferred embodiment disclosed herein does indeed accomplish the aforementioned objects. Obviously, many modifications and variations of the present invention are possible in light of the above teachings. It is, therefore, to be understood that, within the scope of the appended claim, the invention may be practiced otherwise than as specifically described.

I claim:

1. Apparatus comprising:

a central air conditioner housing attached to the ground outside of a building to be air conditioned;

a first fluid conduit extending from said housing;

a second fluid conduit from said housing at a position spaced from and below said first conduit;

an adjustable cover disposed over said housing, said adjustable housing comprising:

a rectangular one piece sheet of flexible material habing a top side, a bottom side, first, second, third and fourth corners and a straight slit extending from a first edge between the first and second corners towards a second edge disposed between the third and fourth corners, thereby forming a triangular flap, said triangular flap extending from said first edge to the end of said slit spaced away from said first edge;

a first fastener attached to said first corner of said sheet;

a second fastener attached to said second corner of said sheet;

first fastener means attached to said sheet at a point adjacent to and equidistant from said slit and said first edge for selective connection to said first fastener;

second fastener means attached to said sheet at a point adjacent to said first edge and disposed between said first fastener and said first fastener means for selective connection to said second fastener;

a first elastic member attached at one end thereof to said sheet at a point between said first fastener means and the end of the slit spaced away from said first edge;

a second elastic member attached at one end thereof to said sheet at a point between said first elastic member and said first fastener means, said elastic member extending between said first and second fluid conduits;

a third elastic member attached at one end thereof to said sheet at a point between said second fastener means and said second elastic member;

a third fastener attached to the other end of said first elastic member;

a fourth fastener attached to the other end of said second elastic member;

a fifth fastener attached to the other end of said third elastic member;

a third fastener means attached to said sheet at a point generally between the second corner and the fourth corner of the sheet and closer to the second corner than to the fourth corner for selective connection to said third fastener;

a fourth fastener means attached to said sheet at a point between the third fastener means and the first edge of the sheet for selective connection to said fourth fastener;

a fifth fastener means attached to said sheet at a point between the fourth fastener means and the first edge of the sheet for selective connection to said fifth fastener;

a sixth fastener attached to said third corner of said sheet;

a seventh fastener attached to said sheet between the sixth fastener and the second fastener and in juxtaposition to said sixth fastener;

an eighth fastener attached to said sheet between the seventh fastener and the second fastener and in juxtaposition to said seventh fastener;

a ninth fastener attached to said fourth corner of said sheet;

a sixth fastener means attached to said sheet at a point generally halfway between said sixth fastener and said ninth fastener for selective connection to said ninth fastener; and a seventh fastener means attached to said sheet at a point generally between said sixth fastener means and said ninth fastener and closer to the ninth fastener than to the sixth fastener means for selective connection to any one of the sixth, seventh or eighth fasteners.

* * * * *